US006762729B2

(12) United States Patent
Egashira

(10) Patent No.: US 6,762,729 B2
(45) Date of Patent: Jul. 13, 2004

(54) SLOTTED BOW TIE ANTENNA WITH PARASITIC ELEMENT, AND SLOTTED BOW TIE ARRAY ANTENNA WITH PARASITIC ELEMENT

(75) Inventor: Yoshimi Egashira, Kanagawa-ken (JP)

(73) Assignee: Houkou Electric Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/231,023

(22) Filed: Aug. 30, 2002

(65) Prior Publication Data

US 2003/0043084 A1 Mar. 6, 2003

(30) Foreign Application Priority Data

| | | |
|---|---|---|
| Sep. 3, 2001 | (JP) | 2001-266273 |
| Sep. 14, 2001 | (JP) | 2001-279499 |
| Oct. 3, 2001 | (JP) | 2001-307375 |
| Jul. 8, 2002 | (JP) | 2002-199125 |

(51) Int. Cl.[7] ..... H01Q 13/10

(52) U.S. Cl. ..... 343/767; 343/700 MS; 343/815

(58) Field of Search ..... 343/700 MS, 767, 343/770, 795, 815, 725, 853

(56) References Cited

U.S. PATENT DOCUMENTS 5,442,367 A * 8/1995 Naito et al. ..... 343/700 MS
6,208,311 B1 * 3/2001 Reece et al. ..... 343/795
6,421,018 B1 * 7/2002 Zeilinger et al. ..... 343/713
6,424,309 B1 * 7/2002 Johnston et al. ..... 343/767
6,429,819 B1 * 8/2002 Bishop et al. ..... 343/725

FOREIGN PATENT DOCUMENTS

JP 2001-186135 7/2001

* cited by examiner

*Primary Examiner*—Tan Ho
(74) *Attorney, Agent, or Firm*—Nixon Peabody LLP; Jeffrey L. Costellia

(57) ABSTRACT

To make improvements in a conventional slotted bow tie antenna to make it possible to (a) broaden the tuning frequency band, (b) function as a dual band antenna, without diminishing the "advantage of enabling a thin shape and possessing directivity". When the symmetrical axis in the longitudinal direction of the bow tie shaped slot is set as x, and the symmetrical axis perpendicular thereto is set as y, a narrow and long parasitic element is placed over and across in the y axis direction, and this parasitic element is insulated electrically from a metal foil provided with a slot, using an insulator, for example. Further, by using two parasitic elements and arranging them in parallel while electrically insulating them from each other, the antenna can also function as a dual band antenna.

12 Claims, 13 Drawing Sheets

PRIOR ART

PRIOR ART

PRIOR ART

PRIOR ART

PRIOR ART

MEASURING FREQUENCY : 2500MHz

SLOTTED BOW TIE ANTENNA WITH PARASITIC ELEMENT, AND SLOTTED BOW TIE ARRAY ANTENNA WITH PARASITIC ELEMENT

BACKGROUND OF THE INVENTION

1. Field of the Invention

The present invention relates to an antenna for transmitting and receiving radio waves of a megacycle (MHz) or gigacycle (GHz), and particularly to an antenna device which can be structured in a thin shape, has a broad tuning frequency band, directivity, high gain, and which can be manufactured inexpensively.

2. Prior Art Statement

FIG. 1A is a side view showing a prior art example of a planar antenna with a reflector, and FIG. 1B is the perspective view thereof.

Reference numeral 6 refers to an emission plate and reference numeral 5 refers to a reflector (see both FIG. 1A and FIG. 1B).

Reference numeral 6*a* is the center portion of the emission plate 6, and at this point the impedance is 0, the current value is maximum and the voltage value is 0.

The impedance changes continuously from the center portion 6*a* to the end portion 6*b*. Point 7 of the impedance of 50 Ω during such change is the feeding point, and a center conductor 8*a* of a coaxial cable 8 is connected thereto. The outside conductor 8*b* of the coaxial cable 8 is connected to the reflector 5.

The aforementioned reflector 5 and emission plate 6 are supported in parallel with the connection conductor 9 at an interval measurement of L.

In this planar antenna example, the radio wave reflected at the reflector 5 is emitted in the arrow Z direction at a maximum of 3 dBd. In terms of bandwidth ratio, the areas of VSWR 2.0 or less are 3 to 5% or less.

FIG. 2A is a side view of a prior art example in which the planar antenna of FIG. 1A was improved in order to obtain broad band characteristics, and FIG. 2B is the perspective view thereof.

Reference numeral 11 refers to an inverted-F antenna element, 11*a* refers to the grounding point thereof, and 11*b* refers to the open end thereof.

The open end 11*b* of this inverted-F antenna element 11 forms the static coupling capacity c by facing and being distanced from the reflector 10. At this open end 11*b*, the impedance is infinite, the current value is 0, and the voltage value is maximum.

At the grounding point 11*a*, the voltage value is 0 and the current value is maximum, and these values change continuously between the open end 11*b* and the grounding point 11*a*. Point 11*c* having an impedance of 50 Ω during such change is the feeding point, and a center conductor 8*a* of a coaxial cable 8 is connected thereto.

The electrical length between the end portion 6*b* and end portion 6*c* of the emission plate is a half wavelength, and the supporting body 10 supporting the center portion 6*a* thereof may be either a conductor or an insulator.

The bandwidth ratio of the prior art example shown in FIG. 2A and FIG. 2B is slightly lower than 10%. The gain is approximately the same as the previous example (FIG. 1A and FIG. 1B), but shows a slight increase.

The thickness measurement (measurement in the Z axis direction) of the antennae of the prior art examples illustrated in FIG. 1A, FIG. 1B, FIG. 2A, and FIG. 2B is comparatively large, and, for instance, will be roughly 20 to 30 mm when designed and manufactured for use at 2.45 GHz. When designed and manufactured for a lower frequency, the thickness will be even larger.

FIG. 3 is a two-view diagram of a publicly known patch antenna. The basic structure of this patch antenna is the same as the prior art examples depicted in FIG. 1A and FIG. 1B, and, therefore, the antenna characteristics are also approximately the same.

The patch antenna is structured from a two-layer substrate shown with reference numerals 21 and 22, a ground plate 26 is formed on one of the faces of this two-layer substrate and a circular antenna element 23 is formed on the other face thereof, respectively with a conduction pattern, and are mutually connected and conducted with a short pin 25 passing through the two-layer substrate.

And, a contact pin 27 is bonded to the feeding point of the foregoing circular antenna element 23 with solder 28 and thereby connected to the strip line 24.

This conventional example, as evident from the structure illustrated in FIG. 3, is structured to have a thickness measurement of two substrates worth of thickness.

Although it is advantageous in that the structure is simple, there is no room for any other improvement in the antenna performance.

Thus, an object of the present invention is to "provide an antenna device suitable in transmitting and receiving radio waves in megacycles or gigacycles, capable of being structured in an extremely thin shape, having a simple structure and low manufacturing cost, yielding superior antenna characteristics (particularly broad band, high gain, directivity), and capable of being structured to have dual band or triple band capability.

As described in detail later, the present invention is an improvement of the slotted bow tie antenna.

Thus, background art relating to a "bow tie antenna" and slotted antenna is described briefly below.

FIG. 4A is a publicly known dipole antenna. (For ease of reading, the conductive portions are shown with spots in FIG. 4A to FIG. 4E.)

The dipole antenna is of the most basic structure, and FIG. 4B shows a modification thereof which is a "bow tie antenna with two triangular metal plates facing each other". As a modification of FIG. 4B, "a wire bent into a triangle" may be used instead of the triangular metal plate.

Reference numeral 12 refers to a high frequency power source, and the two points (1*a*, 1*b*), (2*a*, 2*b*) connected to such high frequency power source in the drawings are feeding points.

Reference numeral 3 in FIG. 4C is a slotted version of the dipole antenna 1, and a part of the metal plate 13 has been cut out.

Similarly, as shown in FIG. 4D, if the metal plate 13 is cut out in a form of a bow tie, a slotted bow tie antenna 14 can be obtained.

For the sake of explanation, the axis x—x illustrated in FIG. 4D will be referred to as the longitudinal symmetrical axis. In the basic form, the longitudinal symmetrical axis x—x is the perpendicular bisector of two sides which are parallel within the hexagon forming the bow tie shape.

The slotted bow tie antenna 14 is drawn in more detail and schematically in FIG. 5.

Reference numeral 14*a* is the right side, 14*b* is the left side, 14*c* is the upper right side, 14*d* is the upper left side, 14*e* is the lower right side, and 14*f* is the lower left side.

The center conductor 8*a* of the coaxial cable 8 connected to the high frequency power source 12 is connected to the feeding point 15*a*, and the outside conductor 8*b* is connected to the feeding point 15*b*, respectively. However, the outside conductor 8*b* may be connected to an arbitrary location of the metal plate 13.

SUMMARY OF THE INVENTION

The slotted bow tie antenna of the present invention is an improvement of the publicly known slotted bow tie antenna (prior art shown in FIG. 5 for example), and, with the longitudinal symmetrical axis of the bow tie shaped slot (14) set as x, and the symmetrical axis perpendicular thereto set as y, "a narrow and long parasitic element insulated electrically" is placed over and across the slot (cut out portion) in the y axis direction. This is the basic structure of the present invention.

As a result of adding the aforementioned parasitic element, the present invention is able to broaden the tuning frequency band width without hindering the advantages of conventional slotted bow tie antennae such as "super thin shape," "simple structure," "directivity", "low cost," and so on.

Moreover, the performance is further improved as a result of establishing two parasitic elements and structuring an array antenna by arranging a plurality of slotted bow tie antennae with parasitic elements.

DETAILED DESCRIPTION OF THE PREFERRED EMBODIMENTS

Figure 6:
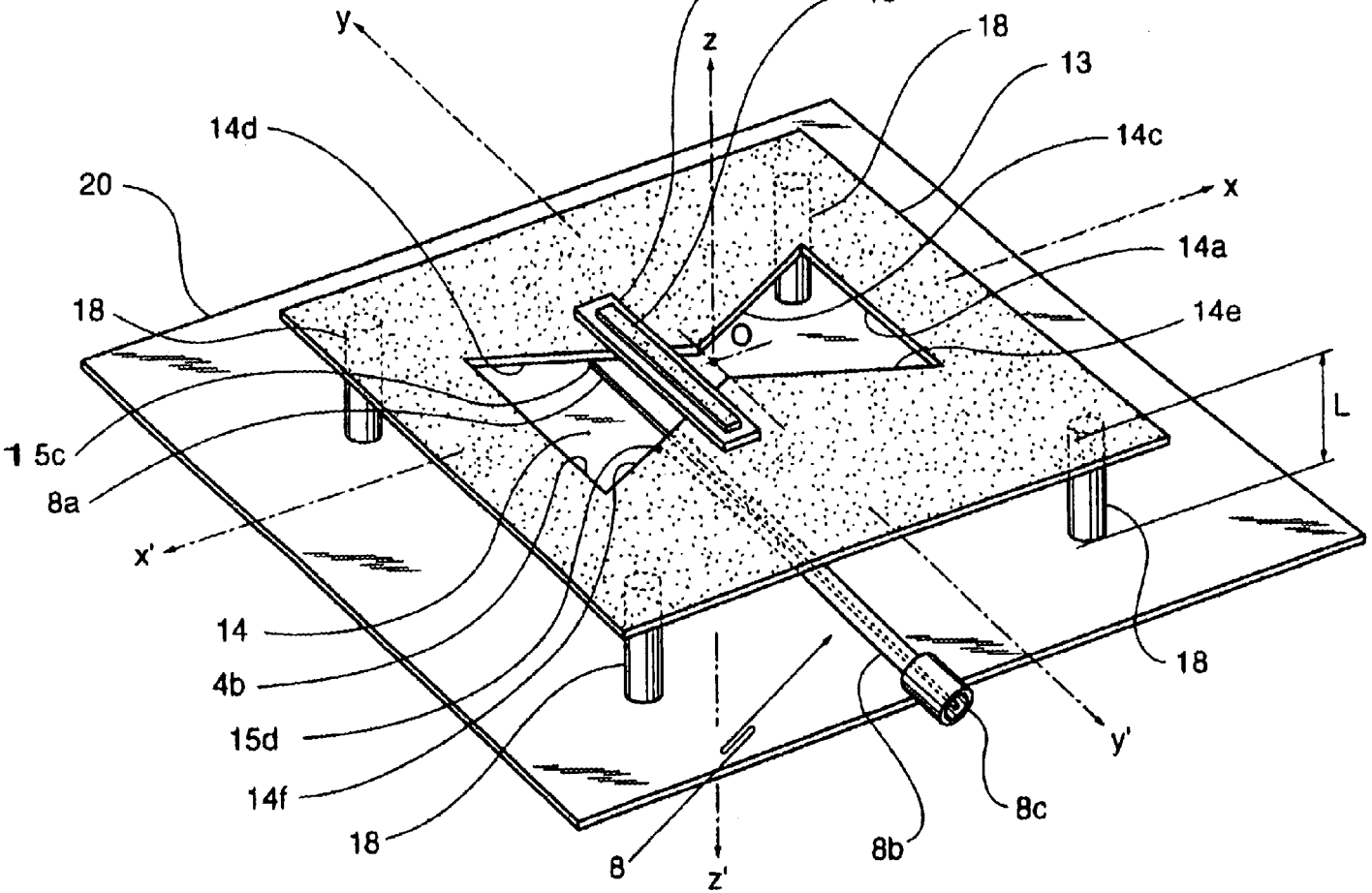
FIG. 6 is a perspective view of an embodiment of the slotted bow tie antenna with a parasitic element according to the present invention.

FIG. 6 is a perspective view illustrating an embodiment of the slotted bow tie antenna according to the present invention.

Figure 1A:
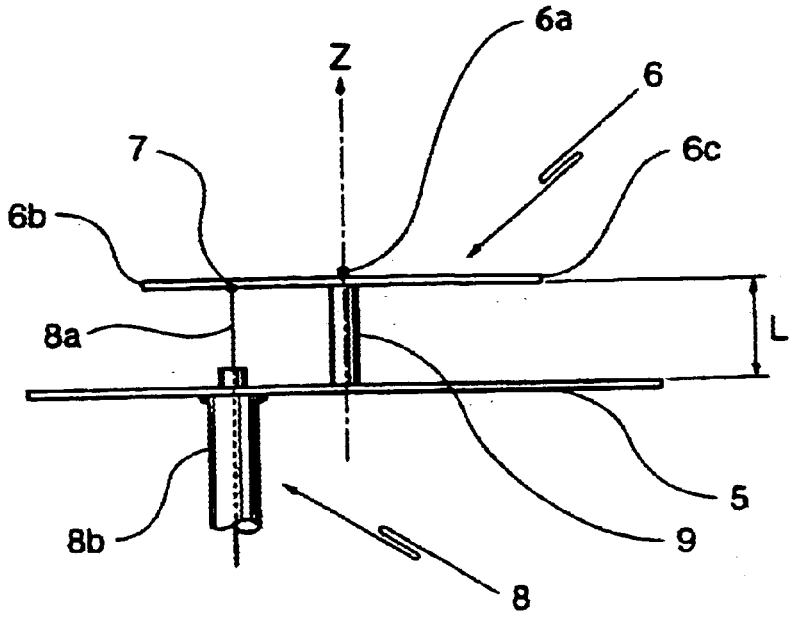
FIG. 1A is a side view of a publicly known planar antenna.
Figure 1B:
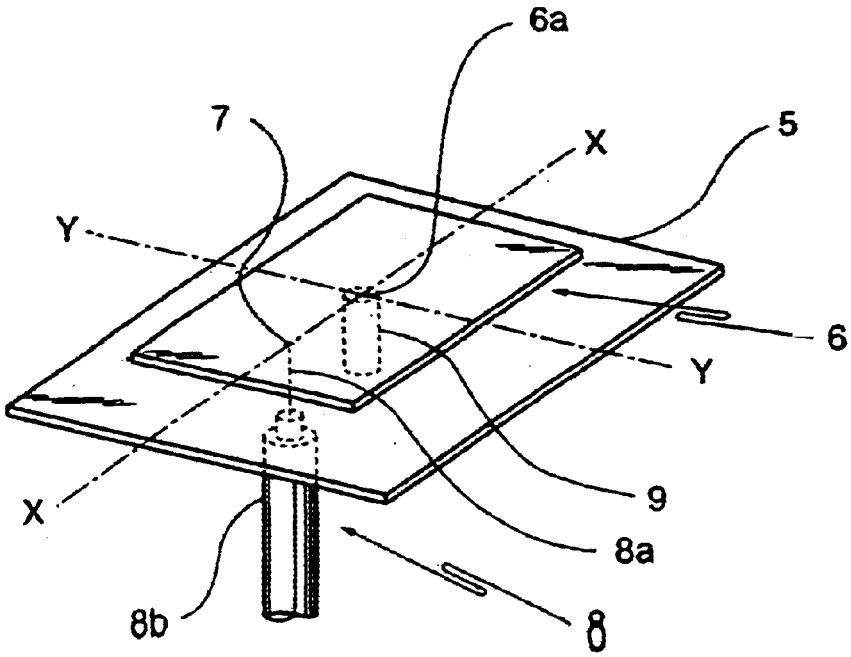
PRIOR ART FIG. 1B
FIG. 1B is the perspective view of the planar antenna.
Figure 2A:
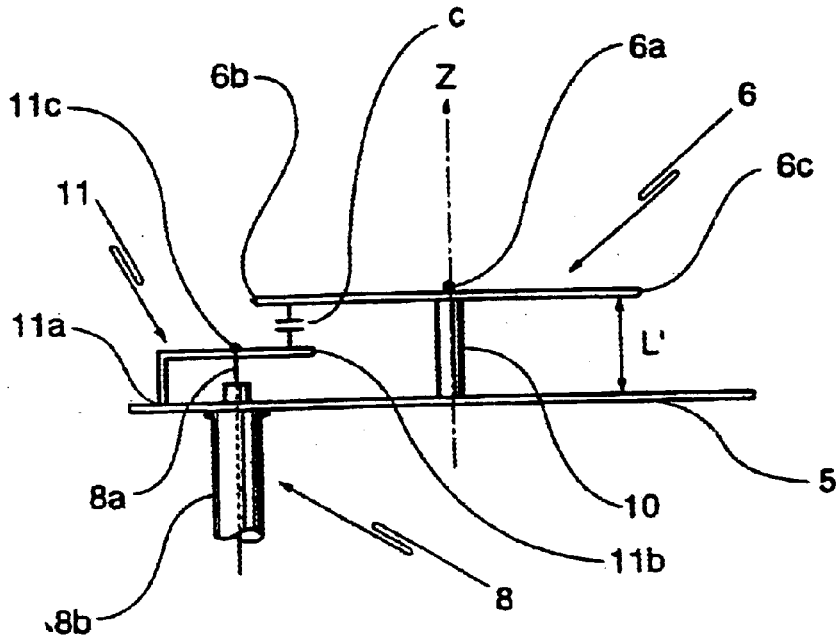
FIG. 2A is a side view of a prior art planar antenna improved so as to broaden the width of the tuning frequency band.
Figure 2B:
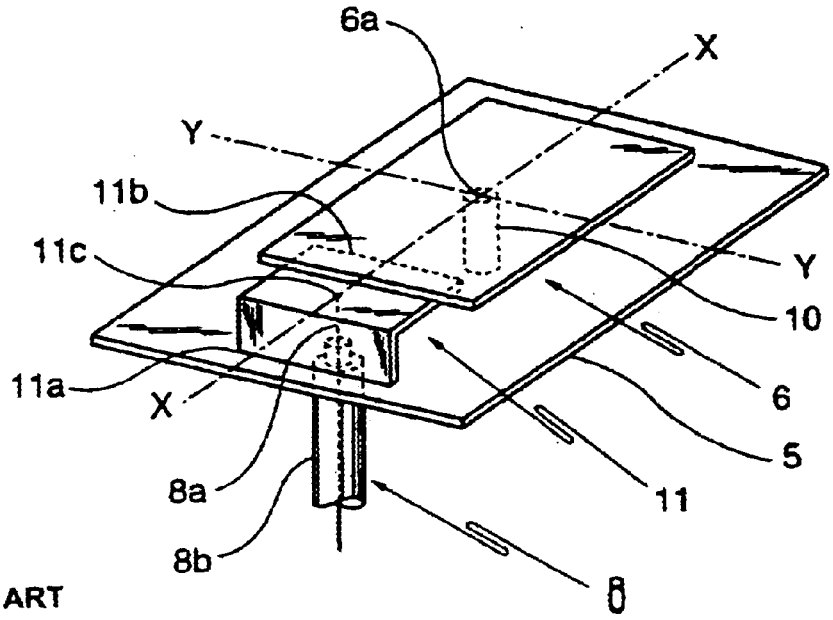
PRIOR ART FIG. 2B
FIG. 2B is the perspective view of the improved prior art planar antenna.
Figure 3:
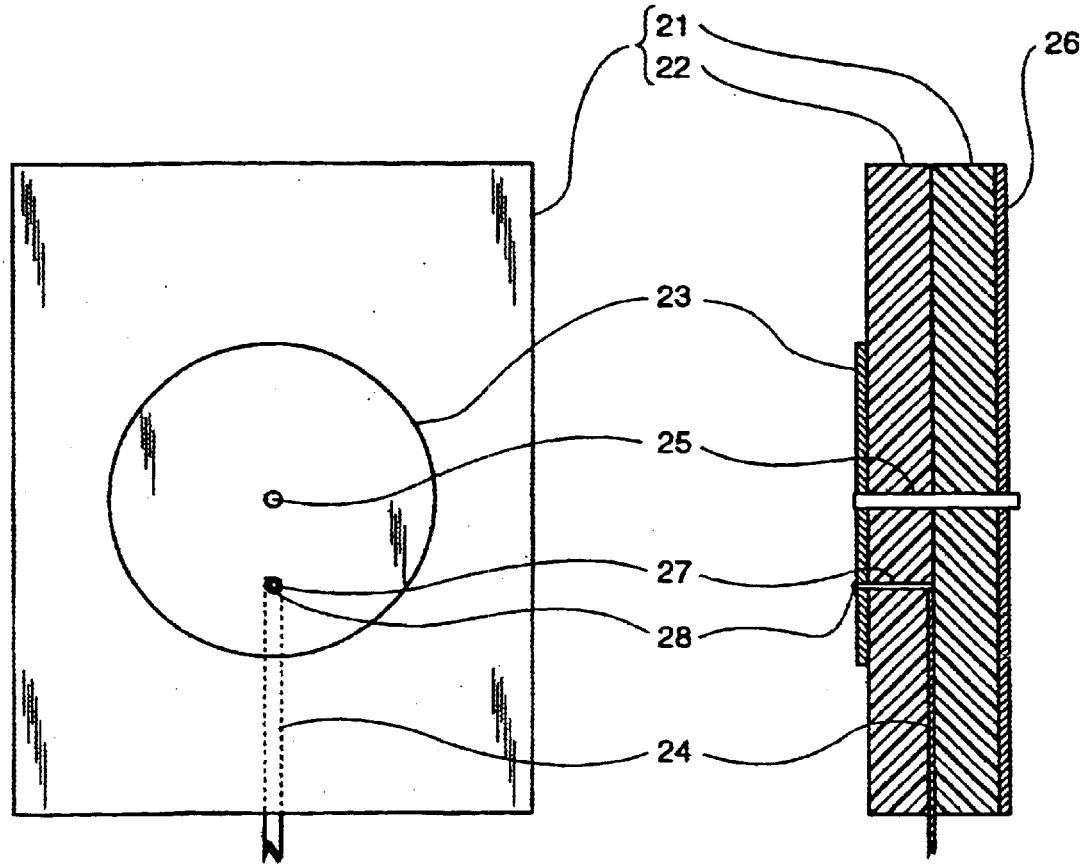
FIG. 3 is a two-view diagram of a publicly known patch antenna.
Figure 4A:
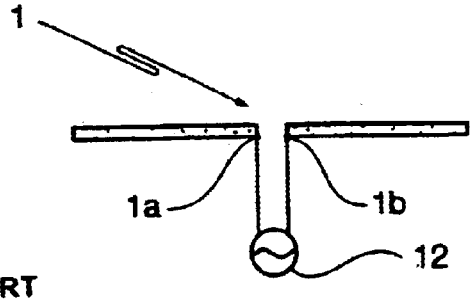
FIG. 4A is a schematic diagram of a publicly known dipole antenna.
Figure 4B:
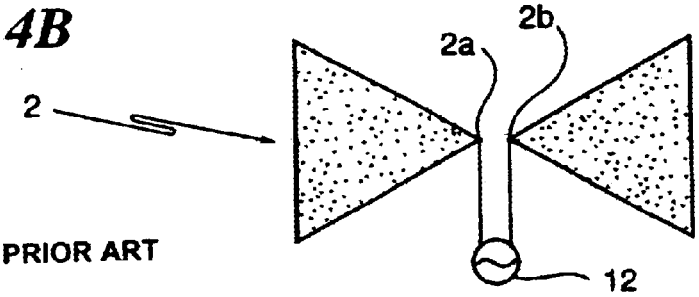
PRIOR ART FIG. 4B
FIG. 4B is a schematic diagram of a publicly known bow tie antenna.
Figure 4C:
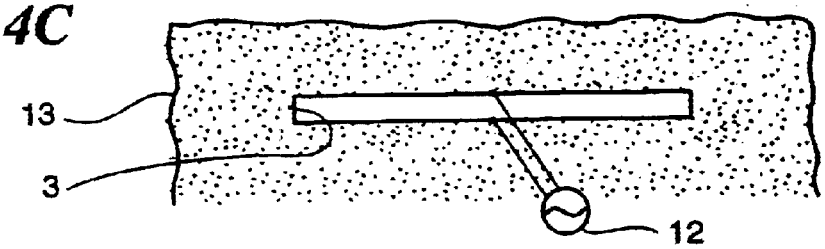
PRIOR ART FIG. 4C
FIG. 4C is a schematic diagram of a publicly known slotted dipole antenna.
Figure 4D:
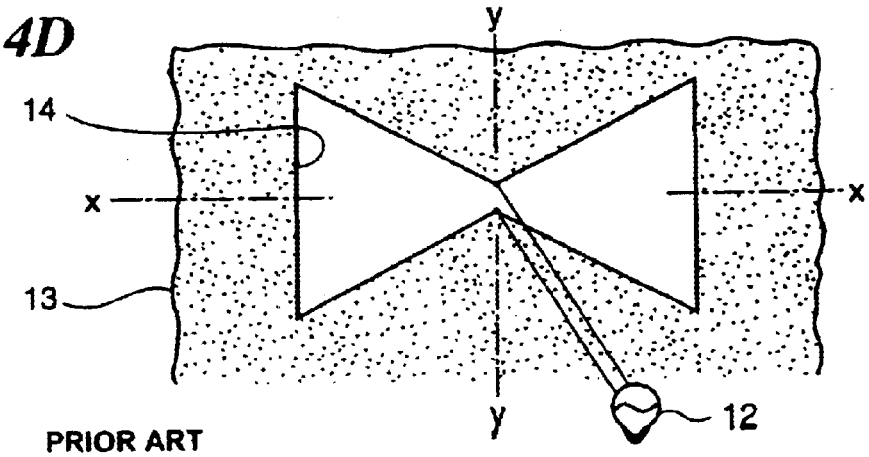
PRIOR ART FIG. 4D
FIG. 4D is a schematic diagram of a publicly known slotted bow tie antenna.
Figure 5:
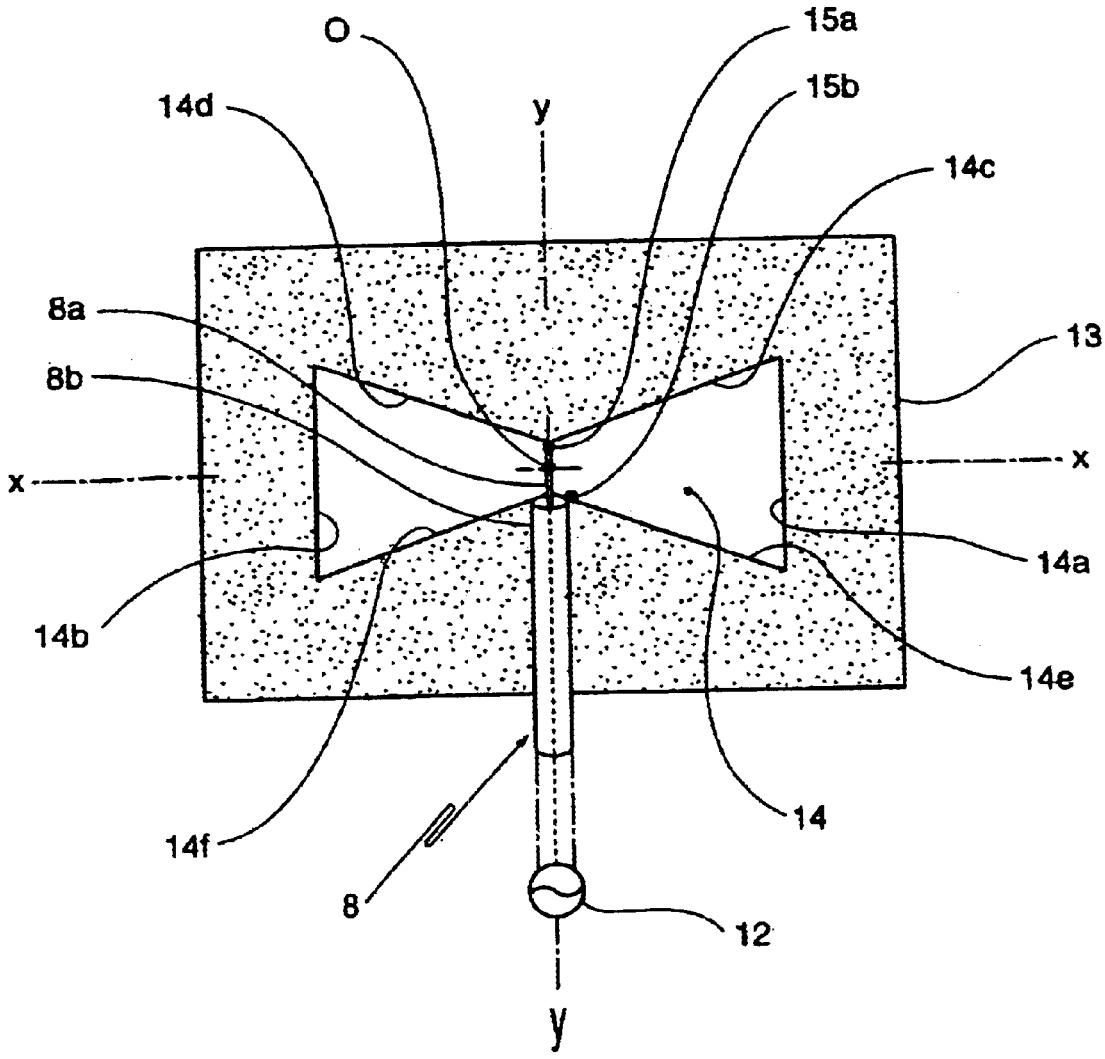
FIG. 5 is a substantive schematic diagram depicting in detail the publicly known slotted bow tie antenna illustrated in FIG. 4D.

Next, the difference with the example in FIG. 5 (prior art) is explained.

A narrow and long parasitic element 16 is placed over and across the bow tie shaped cut out (slot) in parallel with the y axis. This parasitic element 16 is mounted on the metal plate 13 via an insulation plate 17 and electrically insulated.

Reference numerals 15*c*, 15*d* are feeding points and a coaxial cable 8 is connected thereto. Reference numeral 8*c* is a coaxial cable connector.

A reflector 20 is supported with a spacer 18 in parallel to the metal plate 13.

When the reflector 20 does not exist, the slotted bow tie antenna with a parasitic element of the present example has a directivity in the direction of arrows z and z'. If a reflector 20 is provided, a single directivity is obtained in the direction of arrow z.

As the present embodiment (FIG. 6), when a parasitic element 16 crossing the slot is provided perpendicular to the longitudinal symmetrical axis x—x, the resonance characteristics peculiar to the slotted bow tie antenna element and the resonance characteristics peculiar to the parasitic element affect each other via a magnetic current, and, since the metal plate (metal foil) from which the bow tie antenna element has been cut out functions as the ground plate, the impedance matching is performed and the unbalanced current leakage is prevented thereby.

Further, in addition to the interaction via the foregoing magnetic current, broader band characteristics can be obtained by separating the feeding point 15*c* from the y axis.

Next, a modified example of the bow tie shape in the present invention is explained.

Figure 7A:
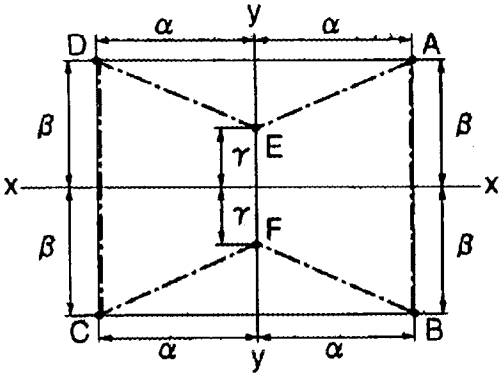
FIG. 7A, FIG. 7B, FIG. 7C and FIG. 7D are schematic diagrams illustrating modified examples of the slotted bow tie element portion in the slotted bow tie antenna with a parasitic element according to the present invention.

As shown in FIG. 7A, with respect to the coordinate axis x–y, point A of $(\alpha, \beta)$, point B of $(\alpha, -\beta)$, point C of $(-\alpha, -\beta)$, point D of $(-\alpha, \beta)$, point E of $(0, \gamma)$ and point F of $(0, -\gamma)$ are defined.

As shown with the chain line, when connecting in the order of A-B-F-C-D-E-A in a straight line, the basic bow tie shape described in FIG. 6 can be obtained.

Figure 7B:
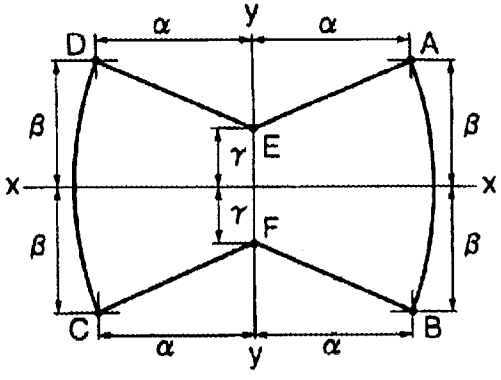

As shown in FIG. 7B, even when A–B and C–D are respectively connected in a convex arc, similar effects and advantages can be obtained.

Figure 7C:
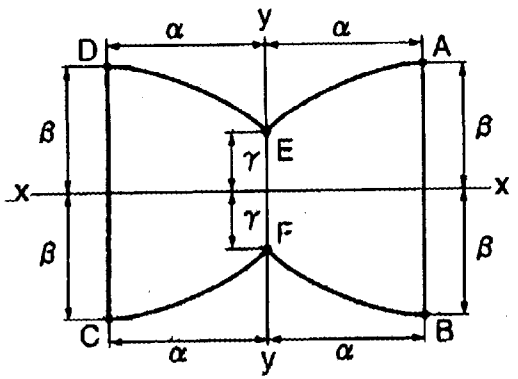
Figure 7D:
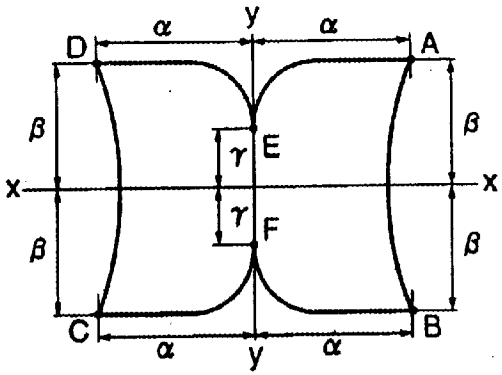

As shown in FIG. 7C, even when the respective zones of D–E, E-A, B–F and F–C are connected in a convex arc, and even when connected with a curved line such as a concave arc or a noncircular arc as shown in FIG. 7D, same or similar effects as with the basic shape can be obtained.

In the embodiment shown in FIG. 6, when the length L of the spacer 18 is adjusted suitably, a two-band antenna that resonates respectively with two types of frequencies can be obtained.

Figure 8:
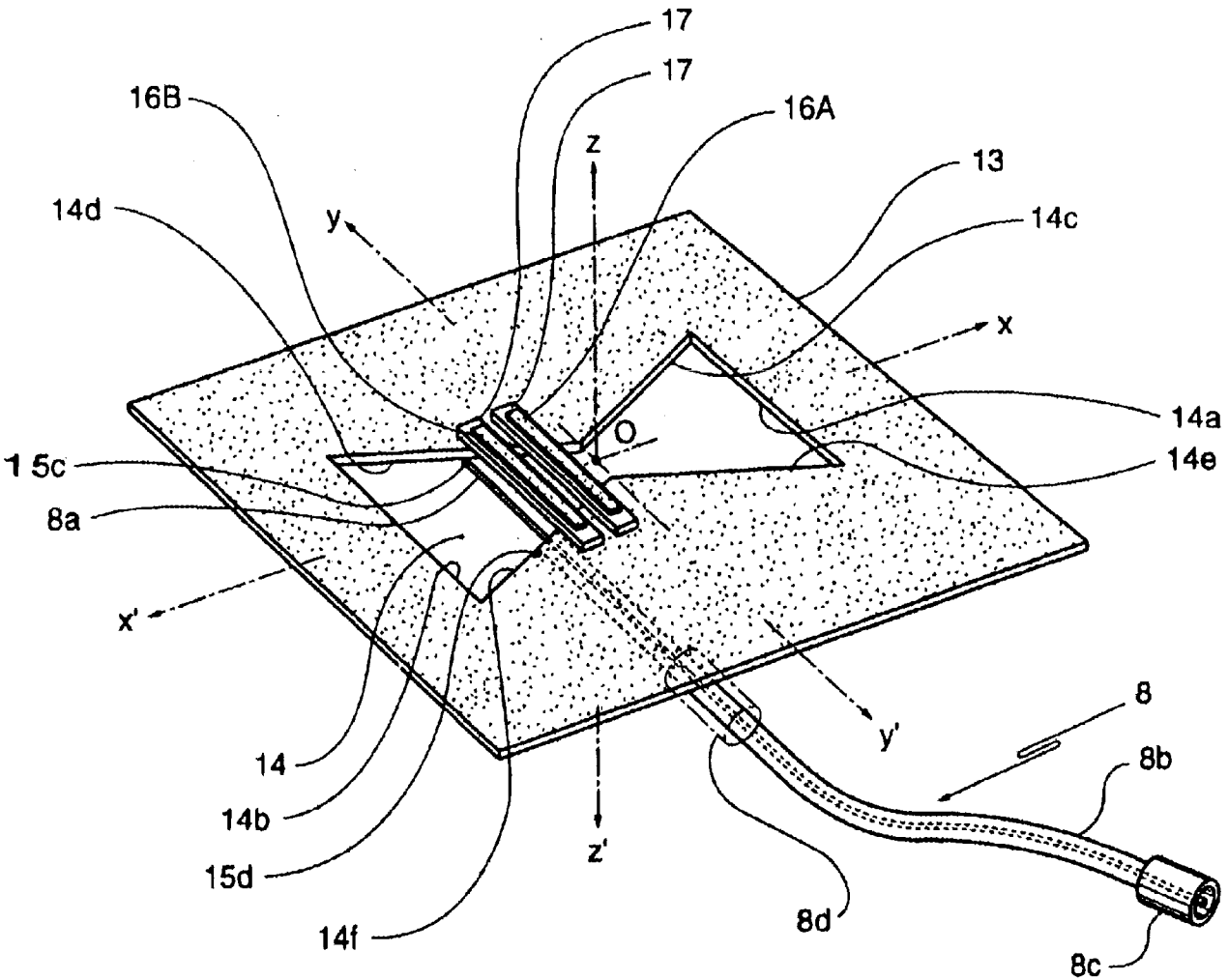
FIG. 8 is a perspective view of an embodiment different from the one shown in FIG. 6.

In order to structure a full scale two-band antenna, as shown in FIG. 8, two parasitic elements 16A and 16B may be provided adjacently in the y axis direction, respectively.

When the coaxial cable 8 is pulled out from the metal plate as shown in the diagram and a coaxial cable connector

8*c* is connected to the tip thereof as shown with the solid line, the process of connecting the slotted bow tie antenna device to the wireless radio is simplified. As shown by reference numeral 8 drawn with a chain line, the coaxial cable connector may also be established at the edge of the metal plate 13.

Figure 9:
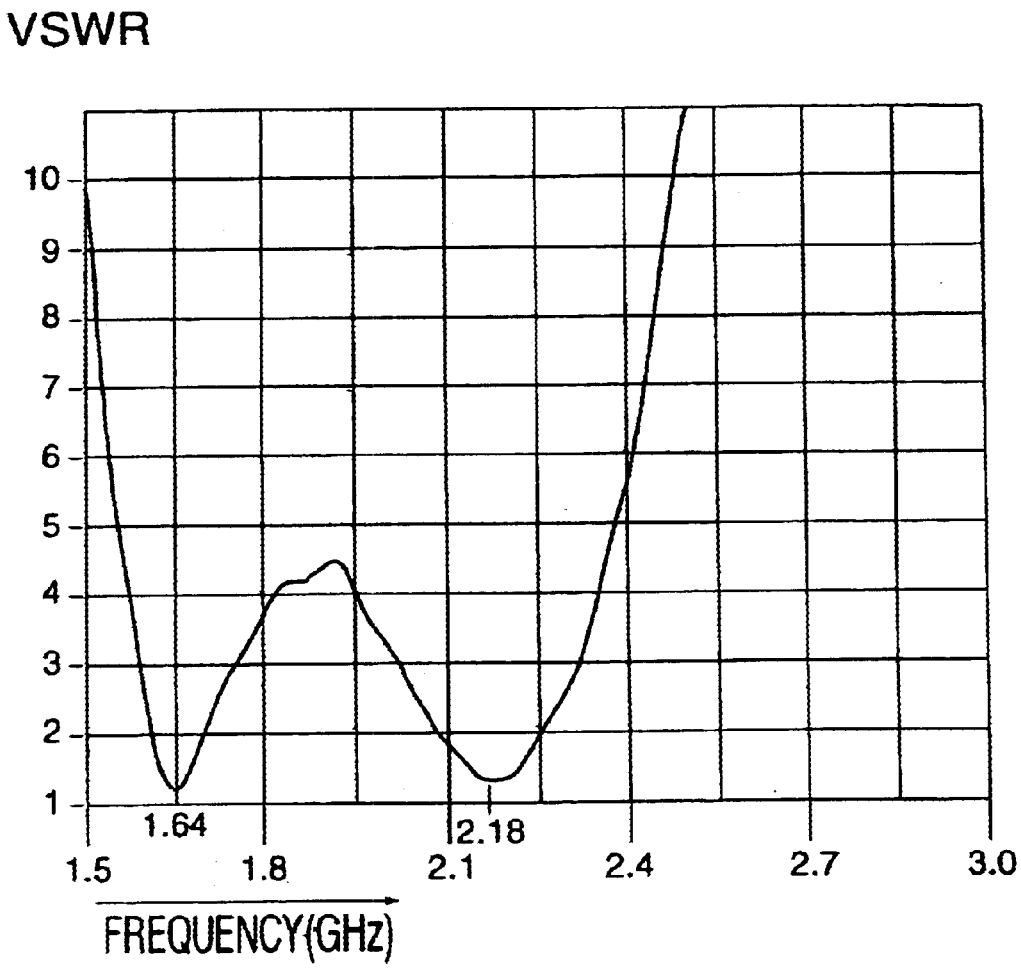
FIG. 9 is a VSWR chart in the embodiment illustrated in FIG. 8.

FIG. 9 is a VSWR characteristic graph (voltage standing wave ratio graph) in the embodiment illustrated in FIG. 8.

In this example, although adjustment is made so as to resonate at both 1.64 GHz and 2.18 GHz, the tuning frequency and tuning frequency band width may be adjusted by variously changing the shape, size, position, or the like of the two parasitic elements 16A and 16B.

Figure 10A:
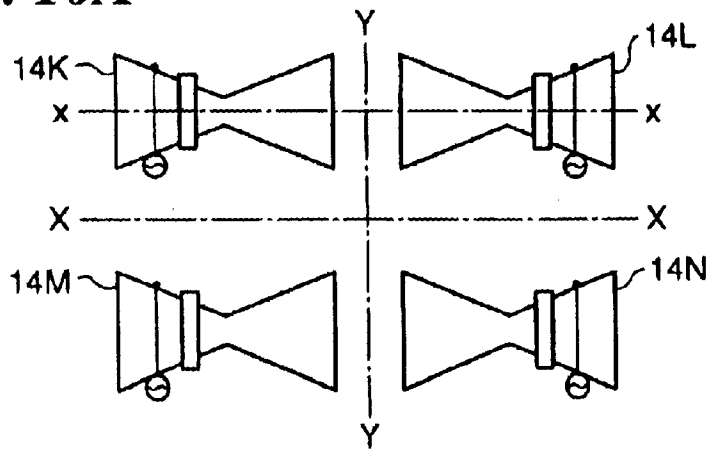
FIG. 10A, FIG. 10B, FIG. 10C and FIG. 10D are schematic diagrams respectively illustrating the unit antenna arrangement in the slotted bow tie array antenna with a parasitic element according to the present invention.

FIG. 10A is a schematic layout diagram showing an example of making the slotted bow tie antenna (with a parasitic element) described above a single unit antenna, and structuring an array antenna by arranging a plurality of unit antennae (4 in this example).

A single unit antenna 14K illustrated in FIG. 10A is a schematic view of the "slotted bow tie antenna comprising a parasitic element and feeding point" explained regarding FIG. 6.

The unit antenna 14K illustrated in FIG. 10B, FIG. 10C and FIG. 10D described in detail later has the same structure as the unit antenna 14K of FIG. 10A.

A principal coordinate axis X parallel to the longitudinal symmetrical axis x of the slotted bow tie antenna and a principal coordinate axis Y parallel to the symmetrical axis y are assumed (See FIG. 10A). These principal coordinate axes X, Y are made not to intersect a bow tie shaped slot (cutout). The appropriate interval measurement will be described in detail later with reference to FIG. 11.

A unit antenna 14L is disposed symmetrical to the unit antenna 14K in relation to the Y axis. Here, "symmetrical" refers not only to the slotted shape, but implies that the shape and position of the parasitic element as well as the feeding point are in symmetry.

Two unit antennae 14M and 14N are disposed in such a manner that the two juxtaposed unit antennae 14K and 14L had been translated in the Y axis direction.

What can be understood from this unit antennae arrangement of FIG. 10A is that "it is strictly symmetrical in relation to the Y axis, but not completely symmetrical in relation to the X axis".

In other words, when focusing only on the bow tie shaped slots (cutouts), although they are symmetrical regarding both the X axis and the Y axis, when focusing on the parasitic elements or feeding points, they are symmetrical in relation to the Y axis but asymmetrical in relation to the X axis.

Figure 10B:
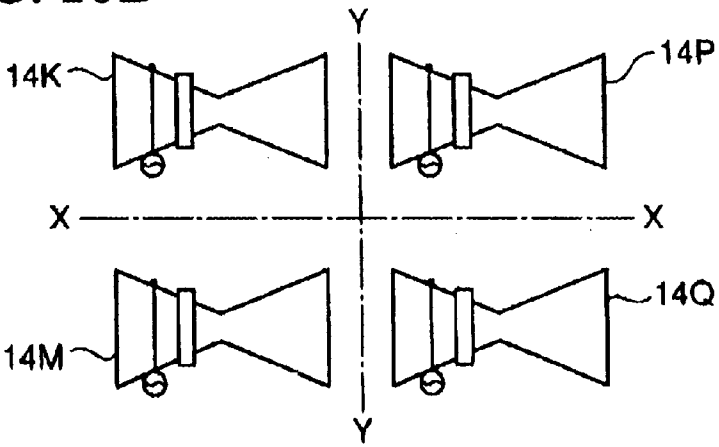

In the embodiment of FIG. 10B, the unit antenna 14P is asymmetrical to the unit antenna 14K in relation to the Y axis, and is disposed as if the unit antenna 14K had been translated in the X axis direction.

As these two unit antennae 14K and 14P are juxtaposed as described above, two other unit antennae 14M and 14Q are arranged in such a manner as if the two unit antennae 14K and 14P were displaced in parallel in the Y axis direction.

As examined above, FIG. 10B is of a different embodiment in comparison to FIG. 10A.

Nevertheless, regarding the effect of improving the gain without diminishing the advantages of a unit antenna, the embodiment of FIG. 10A and the embodiment of FIG. 10B are approximately the same, and the embodiment of FIG. 10C and the embodiment of FIG. 10D described later are also approximately the same.

Figure 10C:
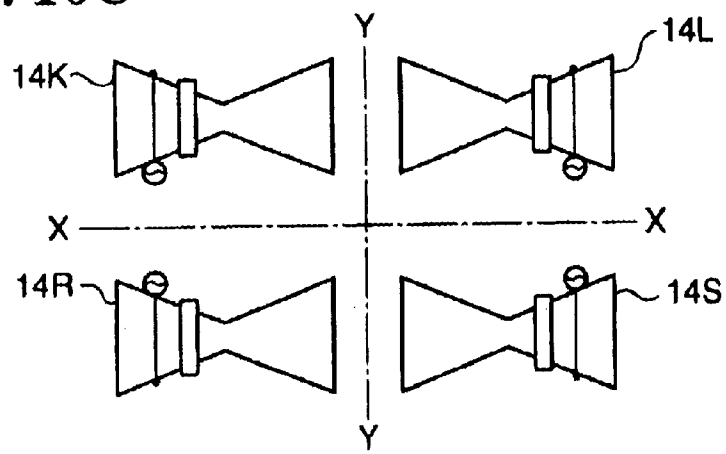

The unit antenna 14K and unit antenna 14L illustrated in FIG. 10C are similar to the two unit antennae 14K and 14L of FIG. 10A.

Further, the two unit antennae 14R and 14S are symmetrical to the foregoing two sets of unit antennae 14K and 14L with respect to the X axis.

Figure 10D:
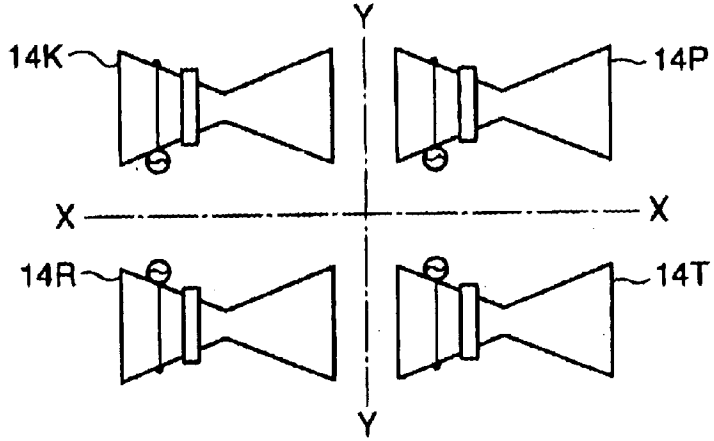

Two unit antenna 14K and unit antenna 14P illustrated in FIG. 10D are similar to the two unit antennae 14K and 14P of FIG. 10B (i.e., they are not of a symmetrical relationship but of a parallel translation relationship).

Further, two unit antennae 14R and 14T of FIG. 10D are symmetrical to the two unit antennae 14K and 14P with respect to the X axis.

Although the array antenna explained with reference to FIG. 10A to FIG. 10D is an example having two rows in the X axis (transverse) direction and two columns in the Y axis (vertical) direction, the array antenna of the present invention may have a minimal structure of two columns, and, generally, may be arranged in M rows and N columns; provided, however, that either one of M or N is an integral number of 1 or more and the other is an integral number of 2 or more.

When arranged in two rows and two columns as in FIG. 10A to FIG. 10D, 16 different arrangements are possible by combining symmetry and parallel translation. Although the designer may arbitrarily select which arrangement to use, the most preferable example is described in detail with reference to FIG. 11.

Figure 11:
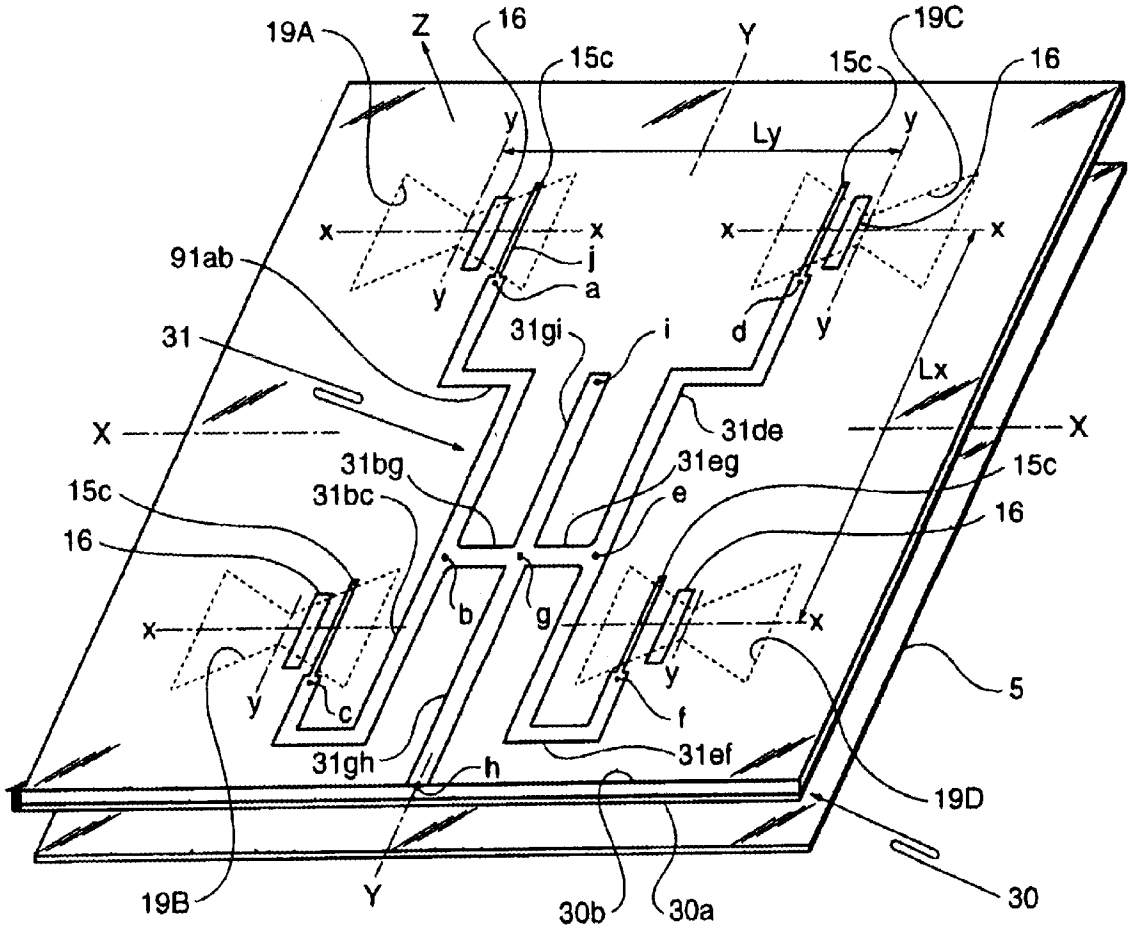
FIG. 11 is a perspective view illustrating an embodiment of the bow tie array antenna with a parasitic element according to the present invention.

FIG. 11 shows an example of a slotted bow tie antenna with a parasitic element structured in two rows and two columns and which has a broad tuning frequency band width (0.1 GHz or more) centered around 2.4 GHz, considerable directivity in a single direction, and high gain.

This example is structured using a double-sided printed board 30. The double-sided printed board may also be employed in the embodiments of FIG. 6 and FIG. 8. When utilizing a double-sided printed board, the antenna device of the present invention may be industrially produced with high precision and at low cost.

Particularly, by employing the double-sided printed board, it is made easier to support the parasitic element 16 while electrically insulating the same.

One side 30*a* of the double-sided printed board 30 has a copper foil deposited on the entire face thereof, four bow tie shaped slots (bow tie antenna elements) 19A, 19B, 19C, 19D are formed by chemically melting and removing a part of such copper foil, and a parasitic element 16 is provided to each of such slots. Reference numeral 15*c* is the feeding point.

The interval measurement Ly between the y axis of the unit antenna formed with the bow tie antenna element 19A and the y axis of the unit antenna formed with the bow tie antenna element 19C is appropriately set between 0.7 $\lambda$ to 1.0 $\lambda$ when the wavelength of the communication radio wave is $\lambda$.

Moreover, the interval measurement Lx between the x axis of the bow tie antenna element 19C and the x axis of the bow tie antenna element 19D is also appropriately set between 0.7 $\lambda$ to 1.0 $\lambda$.

Point h in the diagram is the feeding point of the slotted bow tie array antenna with a parasitic element of this embodiment, and a coaxial cable or a coaxial cable connector is connected thereto (see FIG. 8).

A multiple strip line 31 for feeding is provided for connecting the feeding point 15*c* and feeding point h of each of the four sets of unit antennae described above. This multiple strip line is formed by a conductive pattern at the other side 30*b* of the double-sided printed board 30.

In order to match the phases of the high frequency wave supplied to the respective feeding points 15*c* of the four unit antennae, the electrical length of the strip line from each of the feeding points 15*c* of the four locations to the feeding point h of the array antenna must be equal.

Further, the impedance in the feeding point 15*c* of the respective unit antennae is set to 50 Ω, which is considered to be of minimal loss, and the coaxial cable having an impedance of 50 Ω is connected to the feeding point h of the overall array antenna. Thus, the impedance is matched as described below.

The points to which the tips of the branches of the multiple strip line 31 arrive at slotted bow tie antenna elements 19A, 19B, 19C, 19D are named point a, point b, point c and point d, respectively.

The point which divides into two the electrical length of the strip line connecting point a and point c is named middle point b.

The electrical length of the strip line 31*ab* connecting point a and middle point b is made equal to the electrical length of the strip line 31*bc* connecting point c and middle point b.

Similarly, a middle point e is set, and the strip line 31*de* and the strip line 31*ef* having the same electrical length are provided.

The center point of the line connecting the two middle points b and e is named center point g, which is positioned on the Y axis.

The strip line connecting the middle point b and the center point g is named strip line bg, and the strip line connecting the middle point e and the center point g is named strip line eg.

Thereby, the array antenna feeding portion h and the respective slot bow tie antenna elements are connected with the strip line for feeding, and impedance is matched as described below.

In this example, the structure is such that a coaxial cable of 50 Ω is connected to the array antenna feeding portion h and the impedance of strip lines 31*ab*, 31*bc*, 31*ef*, 31*de* of the branch portions is all made to be 50 Ω.

In this example, a matching means utilizing Q matching is provided between the four strip lines of 31*ab*, 31*bc*, 31*ef*, 31*de* and the array antenna feeding portion h. The specific structure is described below.

Considering a case where Q matching is not utilized with respect to FIG. 11, and viewing from the middle point b, the impedance of the middle point e will be 25 Ω since the two strip lines of 31*ab* and 31*bc* having an impedance of 50 Ω are connected in parallel.

Further, viewing from the center point g, the impedance of the center point g will be 12.5 Ω since the two middle points b, e having an impedance of 25 Ω are connected in parallel.

Thus, Q matching is employed respectively in the strip line 31*bg* and strip line 31*eg* in order to adjust the impedance of the center point g to be 50 Ω. Thereby, the impedance of the feeding point h common to the overall array antenna will be 50 Ω.

The foregoing Q matching is a publicly known technology to those skilled in the art, and a detailed description thereof is omitted since this is mentioned in various communications-related dictionaries (e.g., Technical Terms (Electrical Engineering) edited by Ministry of Education of Japan).

Perpendicular coordinate axes X, Y, Z are assumed (see FIG. 11).

If the illustrated reflector 12 is not provided, the slotted bow tie array antenna with a parasitic element of the present embodiment will show bi-directional directivity in relation to the Z axis direction, and if the conductive reflector 5 is provided parallel to the double-sided printed board 10, directivity will be unidirectional in the arrow Z direction, and the antenna gain will increase.

Nevertheless, the aforementioned multiple strip line 31 is symmetrical with respect to the Y axis but asymmetrical with respect to the X axis. More specifically, the strip line 31*gh* is not symmetrical with respect to center point g.

Therefore, the emission characteristics of the slotted bow tie array antenna of the present embodiment are inclined with respect to the Z axis.

In order to resolve such asymmetry, with this example, a strip line 31*gi* is provided so as to be symmetrical to the strip line 31*gh* with respect to the center point g, and the electrical length thereof is set to λ/4 multiplied by an odd number (where 1 is included in the odd number).

The tip point i of the strip line 31*gi* is connected to conducted with the copper foil of one side 30*a* with the through hole penetrating the double-sided printed board 30.

Although the point i will be grounded in terms of a direct current, by setting the electric length of the strip line 11*gi* to be λ/4 multiplied by an odd number, the impedance from point g to point i in terms of high frequency waves will become infinite, and the inclination of the emission characteristics described above may be resolved thereby.

Although the multiple strip line of the present embodiment (FIG. 11) is provided on the other side 30*b* of the double-sided printed board 30, the portion in which such strip line overlaps with the bow tie antenna element (19A for example), this may also be provided on one side 30*a* of the double-sided printed board 30. For example, the interval between the illustrated point j and the feeding point 15*c* positioned in the vicinity thereof may be provided to one side (back side face in the diagram) 30*a*.

Figure 12:
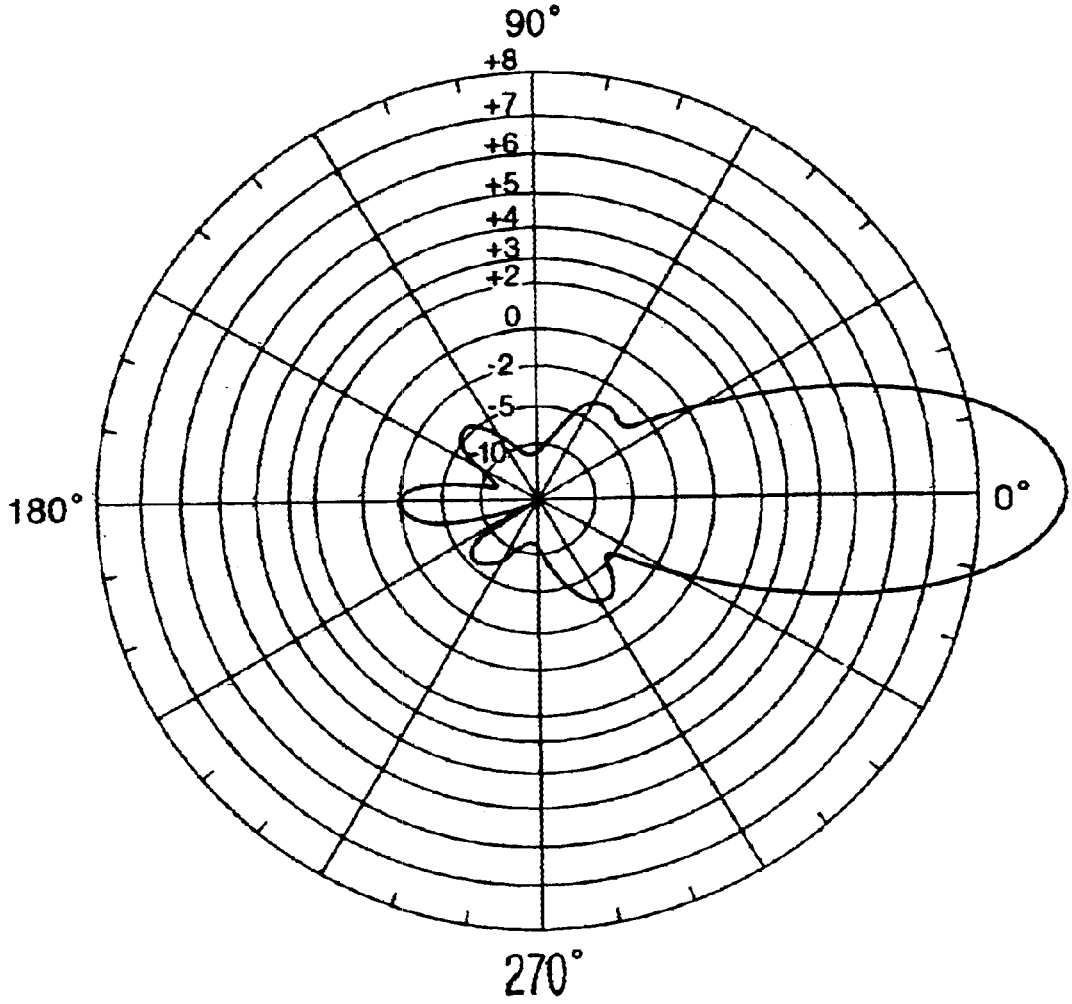
FIG. 12 is a chart representing the directivity characteristics in the embodiment shown in FIG. 11.

FIG. 12 is a graph showing the directivity in the embodiment depicted in FIG. 11. A considerable directivity is represented in a single direction as a result of providing a reflector 5.

Figure 13:
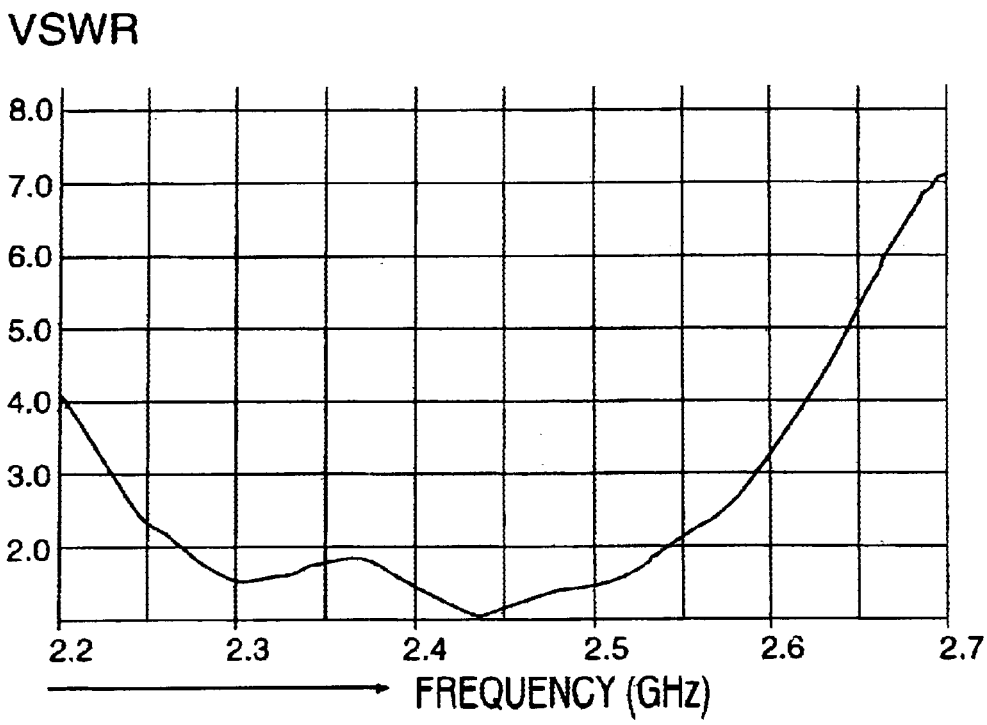
FIG. 13 is a VSWR characteristic graph in the embodiment shown in FIG. 11.

FIG. 13 is a VSWR characteristic graph in the foregoing embodiment, and it is evident that this possesses tuning characteristics of a broad band with 2.4 GHz in the center.

What is claimed is:

1. A slotted bow tie antenna with a parasitic element, a slotted portion of which is formed by removing a part of a metal plate and which has a shape of hexagon formed by overlapping the apexes of two approximately equal triangles or a similar shape thereto, wherein when, of the symmetrical axes of said hexagon, the longitudinal symmetrical axis of said hexagon is set as x axis and the symmetrical axis perpendicular thereto is set as y axis, a narrow and long parasitic element electrically insulated from said metal plate is placed over and across the slotted portion of said hexagon approximately in the direction of the y axis.

2. The slotted bow tie antenna with a parasitic element according to claim 1, wherein there are a plurality of said parasitic elements, said plurality of parasitic elements are electrically insulated from each other, and arranged approximately parallel to each other.

3. The slotted bow tie antenna with a parasitic element according to claim 1, wherein the slotted bow tie element portion of said slotted bow tie antenna with a parasitic element is formed by removing a portion of the metal foil deposited on one side of a double-sided printed board; and said parasitic element is formed by a conductive pattern on the other side of said double-sided printed board.

4. The slotted bow tie antenna with a parasitic element according to claim 1, wherein the slotted portion of said hexagon is formed by removing a portion of the metal foil deposited on one side of a double-sided printed board;

a strip line is provided from the feeding point provided on one of the sides of said hexagon to the vicinity of the edge of the double-sided printed board; and the center conductor of a coaxial cable is connected to said strip line, and the outside conductor of said coaxial cable is connected to said metal foil.

5. The slotted bow tie antenna with a parasitic element according to claim 1, wherein said parasitic element is of a rectangular shape and is configured for controlling at least one of a tuning frequency and a tuning frequency band width of said slotted bow tie antenna.

6. A slotted bow tie array antenna with a parasitic element wherein when orthogonal coordinate axes X, Y are set and an auxiliary axis x parallel to the X axis and an auxiliary axis y parallel to the Y axis are assumed;

a unit antenna is structured from a bow tie shaped slotted antenna element that is symmetrical with respect to the x axis as the longitudinal symmetrical axis and also symmetrical with respect to the y axis perpendicular thereto, and in which a narrow and long parasitic element is placed over a bow tie shaped slot in the y axis direction; and a plurality of unit antennae are arranged in M rows in the X axis direction and in N columns in the Y axis direction, provided that either one of M or N is an integral number of 2 or more and the other is an integral number of 1 or more.

7. The slotted bow tie array antenna with a parasitic element according to claim 6, wherein two unit antennae among the M rows of unit antennae arranged in the X axis direction are arranged symmetrical to each other with respect to the Y axis.

8. The slotted bow tie array antenna with a parasitic element according to claim 6, wherein two unit antennae among the N columns of unit antennae arranged in the X axis direction are arranged such that one of the two unit antennae is approximately equal in shape and size to the other unit antenna when said other unit antenna is translated in the X axis direction.

9. The slotted bow tie array antenna with a parasitic element according to claim 6, wherein two unit antennae among the N columns of unit antennae arranged in the Y axis direction are arranged symmetrical to each other with respect to the X axis.

10. The slotted bow tie array antenna with a parasitic element according to claim 6, wherein two unit antennae among the N columns of unit antennae arranged in the Y axis direction are arranged such that one of said two unit antennae is approximately equal in shape and size to the other unit antenna when said other unit antenna is translated in the Y axis direction.

11. A slotted bow tie array antenna with a parasitic element wherein when orthogonal coordinate axes X and Y are set on a face of a double-sided printed board and an auxiliary axis x parallel to the X axis and an auxiliary axis y parallel to the Y axis are assumed;

a unit antenna is structured from a bow tie shaped slotted antenna element that is symmetrical with respect to the x axis as the longitudinal symmetrical axis and also symmetrical with respect to the y axis perpendicular thereto, and in which a narrow and long parasitic element is placed over a bow tie shaped slot in the y axis direction;

a plurality of unit antennae are arranged in M rows in the X axis direction and in N columns in the Y axis direction;

and wherein said bow tie shaped slot is formed by removing a portion of the metal foil deposited on one side of a double-sided printed board; and said parasitic element is formed by a conductive pattern on the other side of said double-sided printed board.

12. The slotted bow tie array antenna with a parasitic element according to claim 11, wherein a multiple strip line is provided between the respective feeding points of said plurality of unit antennae and the vicinity of the edge of said double-sided printed board;

the center conductor of a coaxial cable is connected to the location where one end of said multiple strip line reaches the vicinity of the edge of the double-sided printed board, and the outside conductor of said coaxial cable is connected to said metal foil; or the center electrode of the coaxial connector is connected to one end of said multiple strip line and the outside electrode of said coaxial connector is connected to said metal foil.

* * * * *